United States Patent [19]

Beasley et al.

[11] Patent Number: 4,730,669

[45] Date of Patent: Mar. 15, 1988

[54] HEAT EXCHANGER CORE CONSTRUCTION UTILIZING A DIAMOND-SHAPED TUBE-TO-HEADER JOINT CONFIGURATION

[75] Inventors: Marvin D. Beasley, Mount Vernon; Michael G. Simpson, Ashley; William T. Shepard, III, Mount Vernon, all of Ill.

[73] Assignee: Long Manufacturing Ltd., Ontario, Canada

[21] Appl. No.: 825,470

[22] Filed: Feb. 3, 1986

[51] Int. Cl.[4] ..... F28D 1/04; F28D 1/02

[52] U.S. Cl. ..... 165/151; 165/153; 165/173; 29/157.4

[58] Field of Search ..... 165/152, 151, 153, 177, 165/173, 175; 29/157.3 B, 157.3 C, 157.4; 228/183

[56] References Cited

U.S. PATENT DOCUMENTS

| | | | |
|---|---|---|---|
| 1,277,526 | 9/1918 | Zimmermann | 165/153 |
| 1,618,485 | 2/1927 | Skinner | 165/151 |
| 1,916,549 | 7/1933 | Young | 165/173 |
| 2,252,211 | 8/1941 | Seemiller | 29/157.3 B |
| 2,488,627 | 11/1949 | Hisey | 165/175 |
| 3,245,465 | 4/1966 | Young . | |
| 3,265,126 | 8/1966 | Donaldson | 165/916 |
| 3,279,532 | 10/1966 | Pfeil, Jr. . | |
| 3,497,936 | 3/1970 | Donaldson . | |
| 3,583,478 | 6/1971 | Fieni . | |
| 3,633,660 | 6/1972 | Young . | |
| 4,125,280 | 11/1978 | Kuzel . | |
| 4,152,818 | 5/1979 | Mort et al. . | |
| 4,159,035 | 6/1979 | Chartet . | |
| 4,159,741 | 7/1979 | Nonnenmann et al. . | |
| 4,226,280 | 10/1980 | Hellouin de Conival et al. . | |
| 4,234,041 | 11/1980 | Melnyk . | |
| 4,369,837 | 1/1983 | Moranne . | |
| 4,377,024 | 3/1983 | Saperstein | 29/157.3 C |
| 4,456,059 | 6/1984 | Cadars . | |
| 4,458,749 | 7/1984 | Melnyk . | |
| 4,465,129 | 8/1984 | Baldensperger et al. . | |
| 4,513,811 | 4/1985 | Lesniak . | |
| 4,529,034 | 7/1985 | Saperstein . | |
| 4,580,324 | 4/1986 | Laska | 29/157.4 |

FOREIGN PATENT DOCUMENTS

| | | | |
|---|---|---|---|
| 2161279 | 4/1973 | Fed. Rep. of Germany | 165/175 |
| 391043 | 10/1908 | France | 165/151 |
| 708355 | 7/1931 | France | 165/151 |
| 0107896 | 8/1980 | Japan | 165/173 |
| 450747 | 7/1936 | United Kingdom | 165/152 |

*Primary Examiner*—Albert W. Davis, Jr.
*Assistant Examiner*—John K. Ford
*Attorney, Agent, or Firm*—Haverstock, Garrett & Roberts

[57] ABSTRACT

A heat exchanger core assembly having an improved tube-to-header joint construction wherein each individual tube end portion is preformed into a diamond-shaped configuration and each mating header plate is likewise preformed to include a plurality of diamond-shaped openings adaptable for receiving the corresponding diamond-shaped tube ends therethrough. Each tube member includes a body portion, a diamond-shaped end portion located at each opposite end thereof, and a gradual transition section which extends from each opposite end of the tube body portion to the respective diamond-shaped tube end portions. When mated together, each tube-to-header joint is bonded together such as by soldering or brazing. Each of the diamond-shaped openings in the mating header plates may also include an increased flange area extending at least partially therearound to improve the structural integrity and strength of the soldered or brazed joint between the tube end portions and the mating header plates.

3 Claims, 21 Drawing Figures

Prior Art Tube-To-Header Joint

HEAT EXCHANGER CORE CONSTRUCTION UTILIZING A DIAMOND-SHAPED TUBE-TO-HEADER JOINT CONFIGURATION

BACKGROUND OF THE INVENTION

1. Field of the Invention

The present invention relates to tube-to-header joints in heat exchanger core constructions and, more particularly, to an improved diamond-shaped tube-to-header joint configuration which offers improved manufacturability and durability and is particularly suited for, but not necessarily limited to, use in heavy duty heat exchanger applications such as engine cooling radiator assemblies. The present invention resides in providing a heat exchanger core construction wherein each of the respective end portions of conventional heat exchanger tube members are formed into a diamond-shaped configuration and mating header plates are constructed to include corresponding diamond-shaped openings for receiving the respective tube end portions therethrough.

2. Description of the Prior Art

The tube-to-header joint interface can be one of the most labor intensive aspects of conventional heat exchanger core assembly manufacture. This is due primarily to the number of tubes and hence joints included in a typical heat exchanger construction. Each end of a conventional tube member must be aligned and then inserted into its respective header slot. While alignment is somewhat predetermined by the engagement of the tubes and the heat transfer fins in plate-fin cores or by assembly fixturing in the case of serpentine fin cores, manufacturing tolerances generally require additional operations to ensure that the proper pre-soldering fit between the tubes and the header slots is obtained. For example, in core assemblies utilizing plate-type fin elements, the tubes are inserted through a plurality of adjacent stacked plate members and this somewhat predetermines the alignment of the tube ends in relation to the respective header slots. In core assemblies utilizing serpentine-type fin elements, the tubes are assembly fixtured between adjacent serpentine fin elements and this fixturing also somewhat predetermines the alignment of the tube ends in relation to the respective header slots. Even though alignment is, in general, predetermined in both cases, additional operations such as tube end opening/flaring operations are still required to ensure that a proper pre-bonding fit between the tube end portions and the header slots is obtained. Opening/-flaring operations help to reduce the clearance between the tube end portions and the tube slots in the header plates and this helps to provide a leakproof fit therebetween. Such opening/flaring steps are not optimal because they exert a considerable amount of stress on the tube walls in the general area of the tube end portion thereby reducing the strength of the tube walls.

Once the tube members are aligned and inserted into the respective header slots, a solder joint or other type of bonding must in turn be effected at each tube-to-header interface. These joints are typically effected by the application of a solder coating to one side of the header plate. The coating is pulled by capillary action into the interface between the outside perimeter of the tube and the tube slot flanges associated with each of the header plates. This solder coating may also be applied by dipping the face of the header plate into a molten solder bath. Alternatively, the solder coating may be applied by spraying molten solder onto the air side (fin side) of the header plate while simultaneously applying heat to the opposite side (coolant side) thereof. These solder joints must be leak free and must be able to endure the load acting thereon between the tubes and header plates resulting from pressure variations, temperature variations, and mechanical stresses occurring during subsequent manufacturing steps as well as during end use operations.

Solder joint strength is generally dependent upon the pre-soldering fit between mating parts. In the case of conventional heat exchanger core constructions, the pre-soldering or pre-bonding fit is determined by the degree of precision in performing the tube end opening/flaring steps to reduce the clearance between the tube end portions and the tube slots in the header plates. The poor fatigue characteristics of soft solder combined with the poor pre-soldering fit in conventional heat exchanger core assemblies and the reduced strength of the tube walls in the general area of the tube end which is caused during the opening/flaring steps results in a tube-to-header interface which is typically the weakest area in a conventional heat exchanger core assembly and hence in a conventional radiator assembly. Thus, since the overall structural integrity of a heat exchanger core assembly is dependent upon the tube-to-header interface, improving the structural integrity of the tube-to-header interface will greatly improve the overall structural integrity of the heat exchanger core assembly and, consequently, the resultant radiator assembly.

In addition to the structural integrity problems associated with conventional heat exchanger core assemblies, there are also efficiency problems associated therewith. For example, associated with the various optional tube-to-header soldering operations described above is the propensity of solder to bridge the gap between opposing side portions of the tubes and either partially or completely obstruct coolant flow therethrough. This can be a distinct problem in core constructions utilizing high aspect ratio (narrow width) tubing which is much more susceptible to tube end plugging during the soldering or brazing process. Tube end plugging that occurs when solder bridges the gap between opposing sides of the tube end portions is undesirable because such plugging has a disparaging effect on heat transfer performance and increases the pumping power required for coolant flow circulation. Plugging may also occur in the tube end portions as a result of blooming corrosion which occurs during the service life of the assembly. Blooming corrosion is generally concentrated at the tube-to-header joint interface and can sometimes bridge the narrow gap between the sides of conventional heat exchanger tube members. Tube end plugging caused by blooming corrosion is likewise undesirable since it also has a disparaging effect on the overall heat transfer performance of the unit and also increases the pumping power required for coolant flow circulation. Thus, reducing the amount of tube end plugging that occurs as a result of either solder bridging or blooming corrosion will greatly increase the overall efficiency of heat exchanger core assemblies.

Other problems associated with conventional heat exchanger assemblies include collapsing of the side walls and/or end portions of the tube members extending therethrough generally known as "hour glassing" which often occurs during the various stages of the manufacturing process. This is particularly true of the oval-type tube members and may occur during the initial installation of the header plates if there is a mismatch in either cross-sectional height or width between the tube ends and the header slots. Collapsing may also occur during the tube-to-header soldering operation. In this case, the rapid heating of the relatively thin tube walls causes the tube cross-sectional perimeter to grow more rapidly than the header slot inside perimeter and produces a similar interference problem between the tube and header slot. Elimination of these problems will greatly increase the production of and will significantly reduce manufacturing time for heat exchanger core assemblies.

Many attempts have been made to solve the problems associated with conventional heat exchanger core assemblies including attempts to increase both the efficiency of heat exchanger core assemblies and improve the tube-to-header joint interface thereby improving the overall structural integrity of the heat exchanger core construction. For example, Melnyk U.S. Pat. No. 4,458,749 discloses a tube-to-header arrangement including a tube member having an oblong or flattened body which is reformed at its respective end portions into a cylindrical configuration for insertion into mating header plates; Moranne U.S. Pat. No. 4,369,837 discloses a tube-to-header joint interface wherein each respective tube end portion is formed into a figure 8 configuration for insertion into mating header plates; and Donaldson U.S. Pat. No. 3,497,936 discloses a method of making a heat exchanger wherein conventional flat-oval tubes are reformed at their respective tube end portions into a rectangular shape for insertion into mating header plates. In addition, Lesniak U.S. Pat. No. 4,513,811, Baldensperger et al U.S. Pat. No. 4,465,129, and Melnyk U.S. Pat. No. 4,234,041 all disclose heat exchanger constructions utilizing header plates having tube slots incorporated therein with an increased flange area extending at least partially therearound for increasing the solder joint surface between the tube slots and the tubes extending therethrough. All such prior art constructions have proved to be less than desirable in both sufficiently reducing tube end plugging and improving the tube-to-header joint interface in an effort to improve the overall structural integrity and efficiency of the resultant heat exchanger assemblies.

The present invention overcomes many of the disadvantages and shortcomings associated with known heat exchanger core constructions, including the above-identified prior art constructions, and improves the structural integrity of the tube-to-header joint by improving the pre-soldering or pre-bonding fit between tube member end portions and the respective openings in the mating header plates by controlling the joint clearances, by providing a mechanically locked joint design and by increasing the distance between the opposing side portions of the individual tube ends thereby reducing or eliminating tube end plugging. The present tube-to-header joint design also reduces or eliminates the need for performing opening/flaring operations on each tube end subsequent to header installation and offers the potential for significantly increased service life for the entire heat exchanger assembly.

SUMMARY OF THE INVENTION

The present invention resides in providing a heat exchanger core construction having an improved tube-to-header joint construction wherein each individual tube end portion is preformed into a diamond-shaped configuration and each mating header plate is likewise preformed to include diamond-shaped openings for receiving the preformed diamond-shaped tube ends therethrough. A gradual transition from locations on a conventionally shaped tube such as a flat oval-shaped tube to each of the diamond-shaped tube end portions is accomplished over a predetermined length of the tube as will be explained hereinafter.

The heat exchanger core construction of the present invention includes a plurality of fin elements, a plurality of tube members adapted to receive a fluid medium therethrough, and a pair of header plates each adaptable to mate with and receive the tube ends at each opposite end of the core assembly. Suitable manifolding is also provided at each opposite end of the core assembly. Each tube member includes a body portion, diamond-shaped end portions, and gradual transition sections which extend from each end of the tube body portion to the respective diamond-shaped tube end portions. The mating header plates each include a plurality of diamond-shaped openings or slots adaptable to receive the corresponding diamond-shaped tube end portions therethrough and, when mated together, each tube-to-header joint is bonded together such as by soldering or brazing. The specific type of bonding utilized may vary depending upon the particular application of the heat exchanger unit. Each diamond-shaped tube slot or opening formed in the respective header plates may also include an increased flange area extending at least partially therearound. This increased flange area increases the structural integrity and maximizes the strength of the soldered or brazed joint between the tube end portions and the mating header plates to further increase the structural integrity and service life of the entire heat exchanger assembly.

The present diamond-shaped tube-to-header joint configuration improves the pre-soldering or pre-bonding fit between the tube end portions and the respective tube slots; it controls the clearances between each respective joint; it provides a mechanically locked joint design; and it reduces or eliminates tube end plugging "hour glassing" of the tube members, and tube end collapsing. The form associated with the diamond-shaped tube end construction also tends to reinforce the tube walls in the transistion area between the conventionally shaped tube being used and the diamond-shaped cross-sectional end areas. In addition, the transition area also provides a means to accomplish a mechanical reinforcement of the solder or braze joint if optional tube end flaring operations are performed prior to the bonding operation.

Accordingly, it is a principal object of the present invention to provide an improved tube-to-header joint which increases the reliability and durability of the joint interface.

Another object is to provide a tube-to-header joint which offers improved structural integrity and manufacturability.

Another object is to provide an improved pre-bonding fit between the respective tube ends and the openings or slots formed in th mating header plates.

Another object is to provide means for controlling joint clearances in tube-to-header joint interfaces.

Another object is to provide a mechanically locked joint design in tube-to-heade joint interfaces.

Another object is to eliminate or substantially reduce tube end plugging, tube end collapsing, and "hour glassing" of tube members which often occurs during the various stages of manufacturing tube and fin type heat exchangers.

Another object is to provide means for substantially increasing the service life of a heat exchanger assembly.

Another object is to teach the construction of a tube-to-header joint wherein each respective tube end portion is formed into a diamond-shaped configuration and each respective header slot is similarly shaped to receive the diamond-shaped tube end portion therethrough.

Another object is to teach the construction of a compact heat exchanger core assembly.

Another object is to teach the construction of a heat exchanger core assembly wherein inter pass baffles may be utilized without modifying the tube layout.

These and other objects and advantages of the present invention will become apparent to those skilled in the art after considering the following detailed specification which discloses several embodiments of the subject device in conjunction with the accompanying drawings.

BRIEF DESCRIPTION OF THE DRAWINGS

FIG. 9(*b*) is an enlarged top fragmentary cross-sectional view of a header plate member showing another optional configuration for the diamond-shaped tube slot of the present invention;

FIG. 9(*c*) is an enlarged top fragmentary cross-sectional view of a header plate member showing still another optional configuration for the diamond-shaped tube slot of the present invention;

FIG. 11(*b*) is a cross-sectional view taken along the lines 11*b*—11*b* FIG. 9(*b*);

FIG. 11(*c*) is a cross-sectional view taken along the lines 11*c*—11*c* of FIG. 9(*c*);

DETAILED DESCRIPTION OF THE PREFERRED EMBODIMENT

Figure 1:
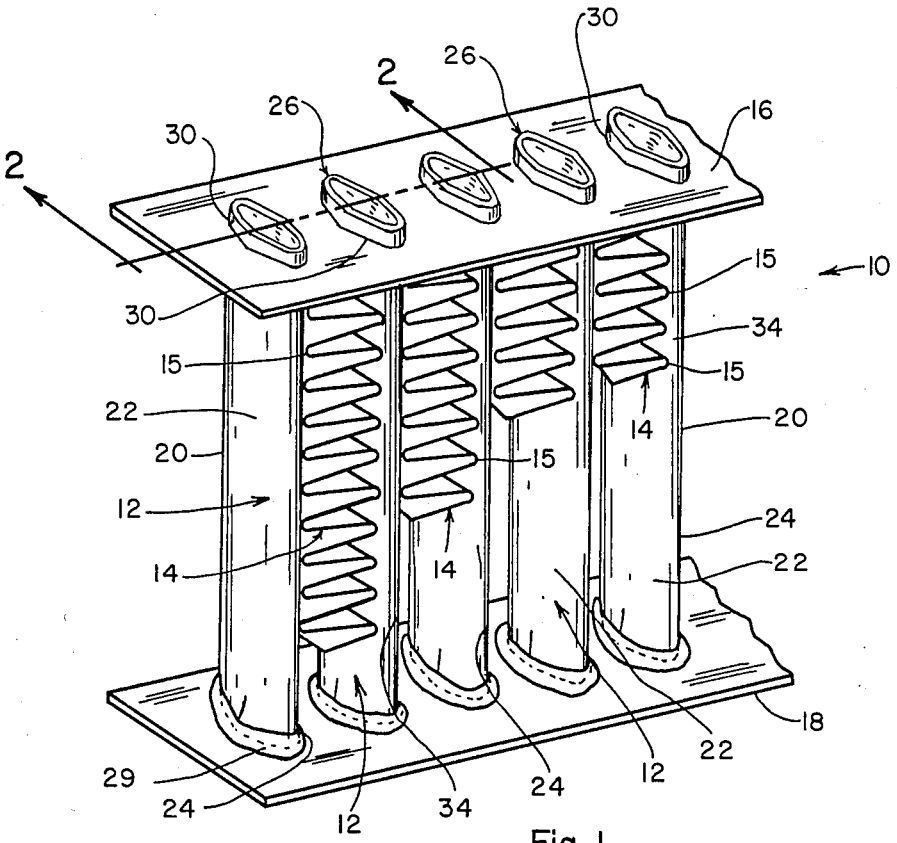
FIG. 1 is a perspective view of a heat exchanger core assembly utilizing a plurality of serpentine fin elements and a plurality of flat oval tube members wherein the tube members are mated to corresponding header plates according to the teachings of the present invention.

Referring to the drawings more particularly by reference numbers wherein like numerals refer to like parts, the numeral 10 in FIG. 1 illustrates a heat exchanger core assembly including a plurality of flat oval tube members 12 and a plurality of serpentine fin elements 14 which are bonded between adjacent pairs of the tube members 12 in a conventional manner. The assembly 10 also includes header plates 16 and 18 which are adaptable to be joined to suitable inlet/outlet tanks and other suitable manifolding (not shown) for directing the various fluid media through the respective flow passageways formed within the core assembly 10. It is also recognized that the header plates 16 and 18 may be integrally formed with the respective inlet/outlet tanks.

Figure 4:
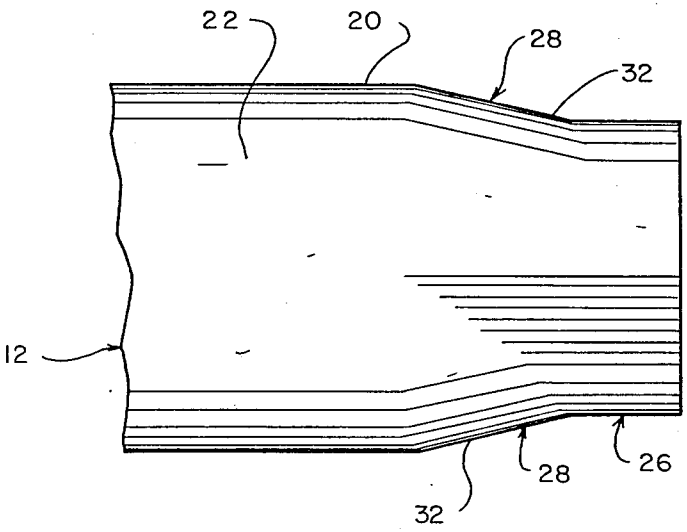
FIG. 4 is a side view of one of the tube members shown in FIGS. 1 and 2.
Figure 3:
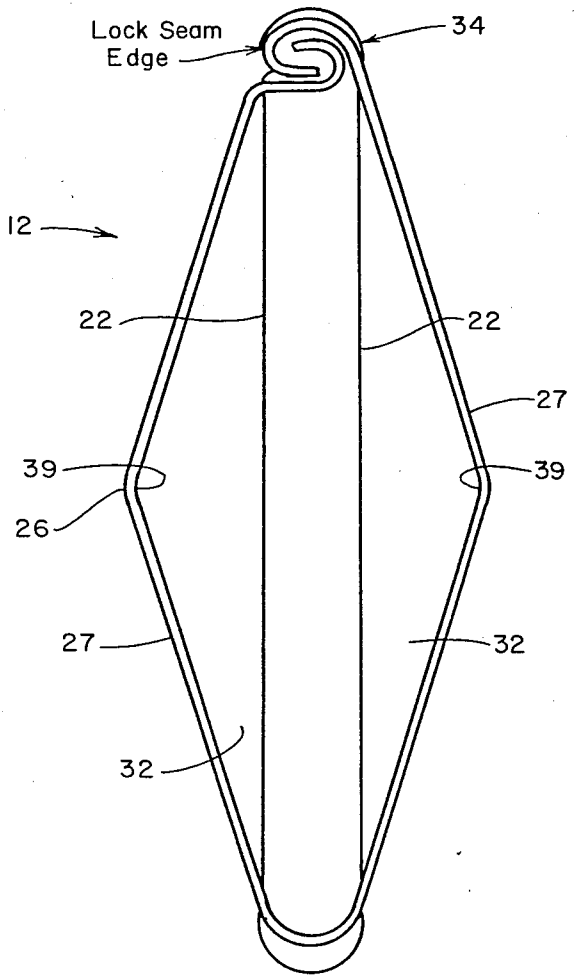
FIG. 3 is an end view of one of the tube members shown in FIGS. 1 and 2 showing the diamond shape configuration.
Figure 5:
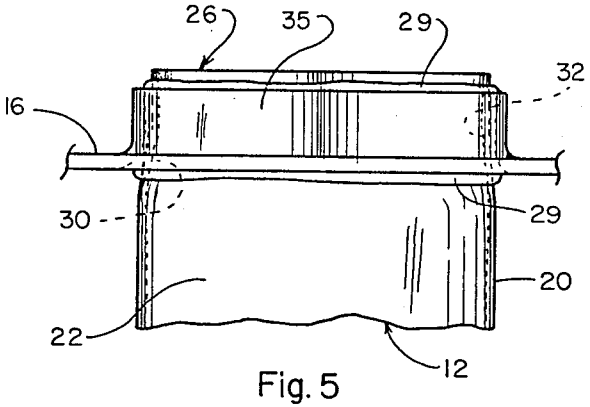
FIG. 5 is an enlarged fragmentary view of one of the tube-to-header joints shown in FIGS. 1 and 2.
Figure 6:
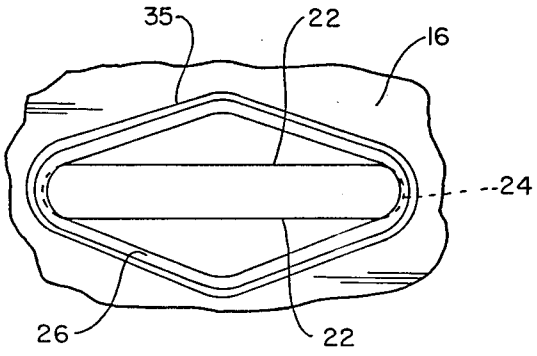
FIG. 6 is an end view of the tube-to-header joint shown in FIG. 5.

Each tube member 12 is formed to include an oval body section 20 having substantially flat, opposed parallel sides 22 and rounded edge portions 24 as best shown in FIG. 1. Each opposite end of the tube body section 20 includes a diamond-shaped end portion 26 and a transition section 28 extending between the body portion 20 and the corresponding diamond-shaped tube end portion 26 as best shown in FIGS. 3 and 4. The fin elements 14 are disposed between pairs of adjacent tube members 12 in spaced apart parallel relationship with each other (FIG. 1) with the crest portions 15 of each fin element 14 being attached to the tube members 12 in a conventional manner such as by soldering, brazing or welding. The mating header plates 16 and 18 likewise include a plurality of corresponding diamond-shaped openings or slots 30 formed therein for receiving the preformed diamond-shaped tube end portions 26 therethrough. Each of the tube end portions 26 is insertable into a respective one of the diamond-shaped slots 30 and secured therein in any convenient manner such as by soldering, brazing or welding. FIGS. 5 and 6 show one of the tube members 12 positioned within a correspondingly formed header slot 30 and secured therein by the solder or braze joint 29.

Figure 2:
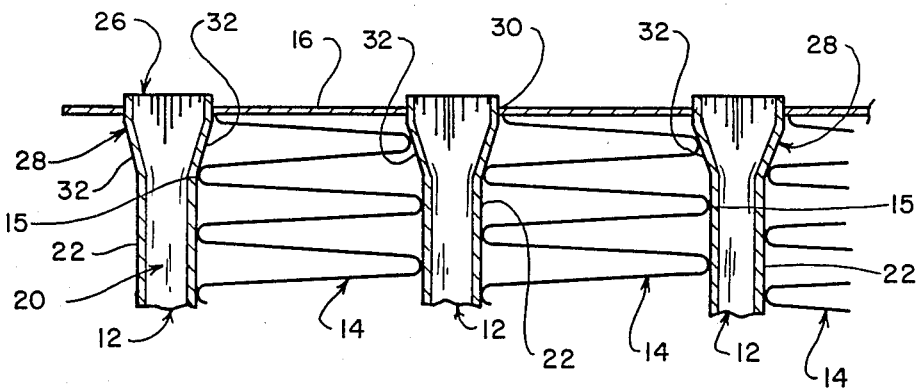
FIG. 2 is an enlarged fragmentary cross-sectional view taken along the lines 2—2 of FIG. 1.
Figure 7:
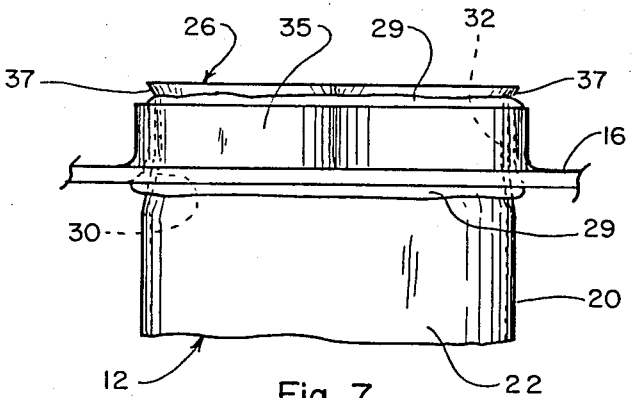
FIG. 7 is an enlarged fragmentary view of one of the tube-to-header joints shown in FIGS. 1 and 2 showing the end portion of the tube member flared.
Figure 8:
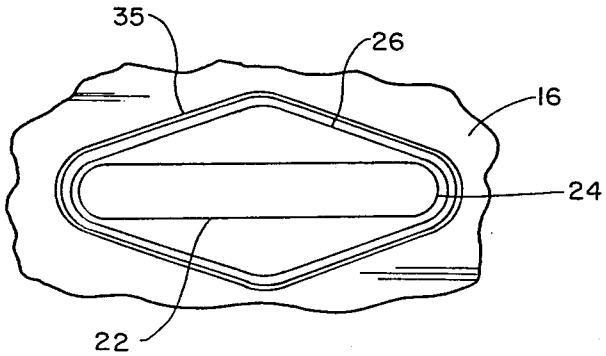
FIG. 8 is an end view of the tube-to-header joint shown in FIG. 7.

Preferably, the outside perimeter of each diamond-shaped end portion 26 is substantially the same as the outside perimeter of the original flat oval-shaped tube member 12. A preferred diamond-shaped form includes the widening of a conventional flat oval tube in the middle portion thereof to approximately 3.5 times the normal tube cross-sectional width as shown in FIG. 3. This increase in width is accompanied by a corresponding reduction in cross-sectional height. In a typical application, the overall length of the diamond-shaped end portion 26 is limited to approximately 0.125 inches adjacent the tube end. This of course will vary depending upon the particular use and application involved. Typical assembly tolerances in the range of 0.001 inches to 0.003 inches between the tube end and the header slot are normally employed in this area. A gradual transition which extends from an intermediate portion of the flat oval-shaped tube section 20 to the diamond-shaped tube end 26 is accomplished over a predetermined length equal to the length of the transition sections 28 shown in FIGS. 2 and 4. Again, the length of the transition sections 28 may vary depending upon the particular application involved. Regardless of its overall length, the taper of the transition areas 28 provides a means to minimize the clearance required between the tube ends 26 and the sides of the header slots 30 and it also provides a means to accomplish a mechanical reinforcement of the solder or braze joint 29 if optional tube end flaring operations are performed prior to the soldering operation. While the necessity for performing tube end opening/flaring operations on the tube members 12 constructed according to the teachings of the present invention is substantially reduced or eliminated as previously explained, such operations can still be performed if desirable. FIGS. 7 and 8 show one of the tube members 12 positioned within a corresponding header slot 30 having its diamond-shaped end portion 26 flared as at 37.

Although it is possible to form each tube member 12 of the present invention as a seamless member, the more economical method of forming the present tube members having the diamond-shaped end portions 26 associated therewith is to form each tube member 12 from a single sheet of tube material by folding the sheet of material into the appropriate tube shape and then welding the opposite sides thereof or lapping and soldering or brazing the opposite sides thereof along what is commonly referred to as the lock-seam edge of the tube. FIG. 3 illustrates how one of the present flat oval-shaped tube members 12 is formed from a single sheet of tube material and details one arrangement of the lock-seam area or edge 34 of the tube 12 to achieve the diamond-shaped end portions 26.

Figures 9A, 9B, 9C, 10A, 10B, 10C, 11A, 11B, 11C:
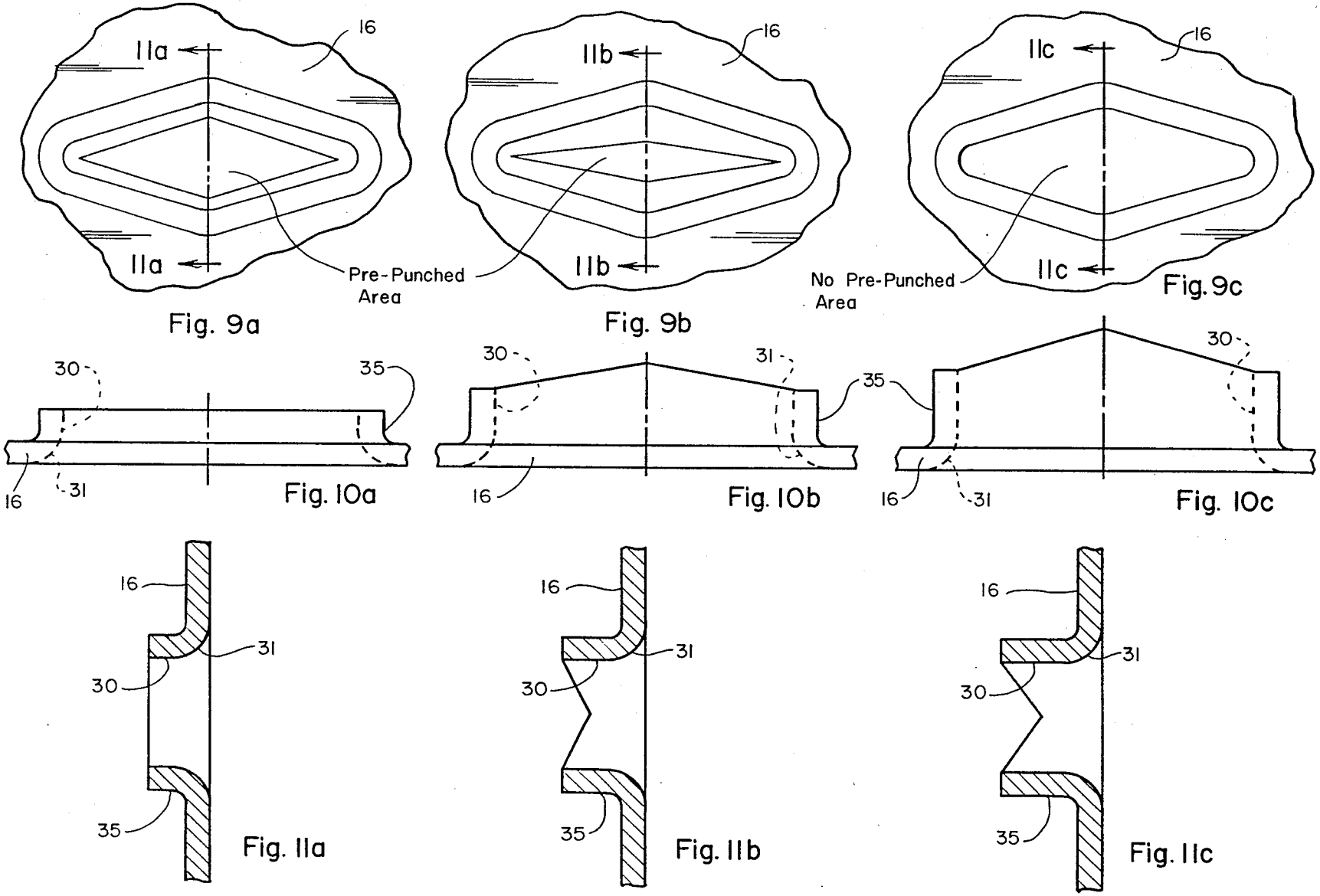
FIG. 9(*a*) is an enlarged top fragmentary cross-sectional view of a header plate member showing one optional configuration for the diamond-shaped tube slot of the present invention.
FIGS. 10(*a*), 10(*b*) and 10(*c*) are side views of the header plate tube slots shown in FIGS. 9(*a*), 9(*b*) and 9(*c*) respectively.
FIG. 11(*a*) is a cross-sectional view taken along the lines 11*a*—11*a* of FIG. 9(*a*)

FIGS. 9(*a*) and 10(*a*) illustrate one optional configuration for the diamond-shaped header slots 30. FIGS. 9(*b*), 10(*b*) and 9(*c*), 10(*c*) illustrate still other optional diamond-shaped header slot configurations which can be provided by varying the shape of the prepunch utilized before the final tube flange forming punch is achieved. The pre-punch and no punch areas indicated in FIGS. 9(*a*), 9(*b*) and 9(*c*) determine the overall height of the flange member 35 extending around the header slots 30 as best shown in FIGS. 11(*a*), 11(*b*) and 11(*c*), the header slot configuration illustrated in FIGS. 9(*c*), 10(*c*) and 11(*c*) producing the larger flange area. The peripheral flange 35 is provided to increase the overlap between the mating surfaces of the tubes and the header slots in order to effect sufficient bonding therebetween. The advantages associated with these optional header slot configurations are twofold. First, the radius 31 around the bottom portion of the header slots 30 as best shown in FIGS. 11(*a*), 11(*b*) and 11(*c*) provides a lead-in for tube insertion. This helps to eliminate damage to the tube ends during initial installation of the header plates. Second, these optional header slot configurations also provide an increased flange area 35 around the header slots 30 as previously explained to improve bonding with the tube end portions. The depth of insertion of the tubes 12 within the slots 30 is controlled by the increasing tube cross-sectional height from the diamond-shaped end portion 26 toward the flat oval cross-section of the tube body 20. This feature has proved to be advantageous in minimizing leakage in the end radius area 31. A high percentage of tube header leaks in conventional joint designs tend to be located in this area, particularly on the lock-seam edge of the tube. Failure of tube-to-header joints resulting from strains imposed during normal operating conditions also tend to occur first in the end radius areas.

A particular advantage of the present diamond-shaped tube-to-header joint is associated with the reinforcing means afforded by the bend radius 39 (FIG. 3) which is formed in the flat tube sides 22. This bend radius 39 helps to prevent the collapsing of the tube wall portions 27 and 32 in the area of the transition sections 28 and the tube ends 26. Other optional tube end reforms such as elliptical or round shapes may require the addition of various shaped pairs of reinforcing ribs and/or dimples which add additional stress to the tube walls during forming See U.S. Pat. No. 4,458,749. Distinct ribs or dimples tend to concentrate stresses in local areas of the tube wall. The mild ribbing associated with the gradual transition from the flat oval section of the tube to the elongated diamond-shaped tube end distributes stresses more evenly in the tube walls yet provides sufficient reinforcement to prevent flexing of the unsupported tube walls between the header plates and the finned section of the tubes. The present diamond-shaped tube end and header slot configuration also eliminates the potential for tube end collapsing during the header installation and soldering processes. Differential thermal growth between the perimeter of the tube ends and the perimeter of the header slots aids the soldering process by reducing the clearance between the tube wall and header slot. Since the present tube ends 26 are constrained upon insertion of the tubes 12 into the header slots 30, the tube side walls 32 located beyond the point of engagement of the tubes 12 with the slots 30 are forced outwardly rather than collapsing inwardly as the perimeter of the tube walls 32 grow during the heating process.

Another important aspect of the present diamond-shaped tube-to-header joint configuration, as opposed to prior art tube end forms such as elliptical or round tube end forms, relates to the minimal stress and deformation required of the previously formed lock-seam joints in the tubing. As shown in FIG. 3, the diamond-shaped end form requires only a small widening of the previously formed end radii of the tube. This is particularly advantageous in the lock-seam area 34 (FIGS. 1 and 3) of the tube members 12 where the tube walls have already undergone work hardening and additional reforming stress can result in rupture and leakage. Thus, the lock-seam or welded area 34 of each of the tube members 12 is subjected to minimal stress and distortion during the tube end reshaping process. Although the proposed diamond-shaped tube-to-header joint offers particular advantages with respect to joints formed with lock-seam tubing, it is also suitable for joints formed with welded or seamless flat oval-shaped tubing.

Figure 12:
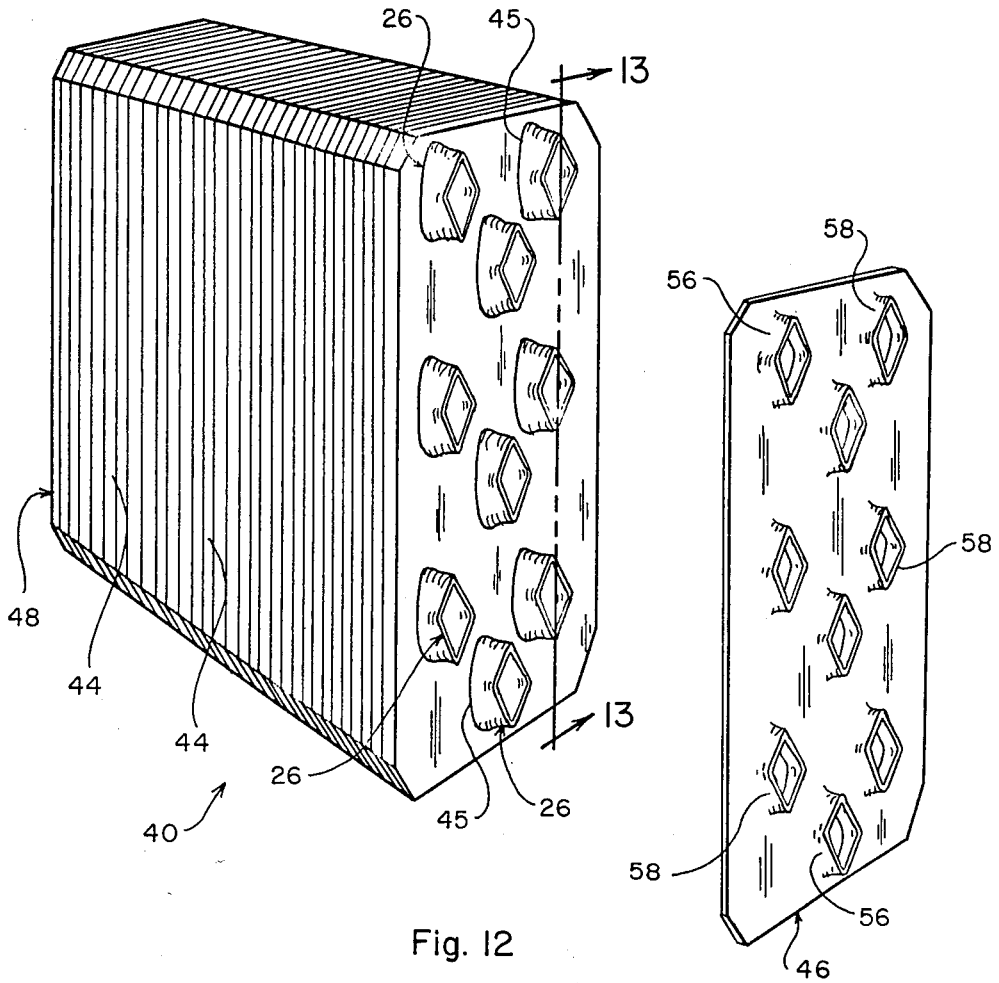
FIG. 12 is a partially exploded perspective view of a charge air cooler core assembly utilizing a plurality of plate-type fin elements and a plurality of flat oval tube members wherein the tube members are mated to corresponding header plates according to the teachings of the present invention.
Figure 13:
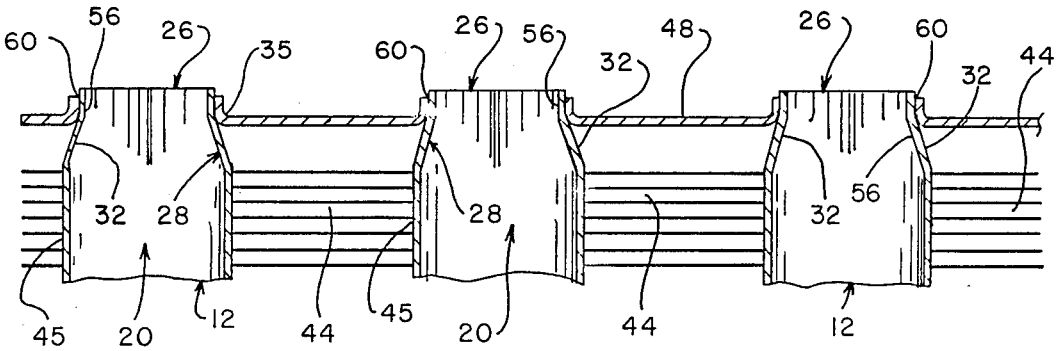
FIG. 13 is an enlarged fragmentary cross-sectional view taken along the lines 13—13 of FIG. 12.

In an alternate plate and fin heat exchanger embodiment shown in FIGS. 12 and 13, a heat exchanger core assembly 40 includes a plurality of the present flat oval tube members 12 which extend through and are connected to a plurality of planar or plate-type fin elements 44 to achieve a cross-flow pattern of fluid distribution therethrough whereby two fluid media pass through the core assembly 40 in heat exchange relationship with each other. Each fin element 44 includes a plurality of apertures 45 formed therein adaptable to receive the appropriate portion of the tube members 12 when positioned therethrough. Each fin element 44 may also include means on at least one surface thereof in the form of corrugations (not shown) for directing at least a portion of the air flow or other fluid medium over the fin members 44 and around the tube members 12 extending therethrough so as to enhance the heat transfer capability of the assembly 40. The core assembly 40 also includes header plates 46 and 48 which are constructed to include a plurality of diamond-shaped tube slots 56 for receiving the diamond-shaped tube end portions 26 therethrough. In this particular embodiment 40, the tube members 12 are staggeredly arranged as shown in FIG. 12, although any other arrangement may likewise be utilized. Each of the tube slots 56 likewise includes an increased flange area 58 extending therearound which increases the structural integrity and maximizes the strength of the soldered or brazed joint 60 (FIG. 13) between the tube end portions 26 and the mating header plates 46 and 48 to further prevent failure of the heat exchanger core assembly 40 as previously explained.

Figure 14:
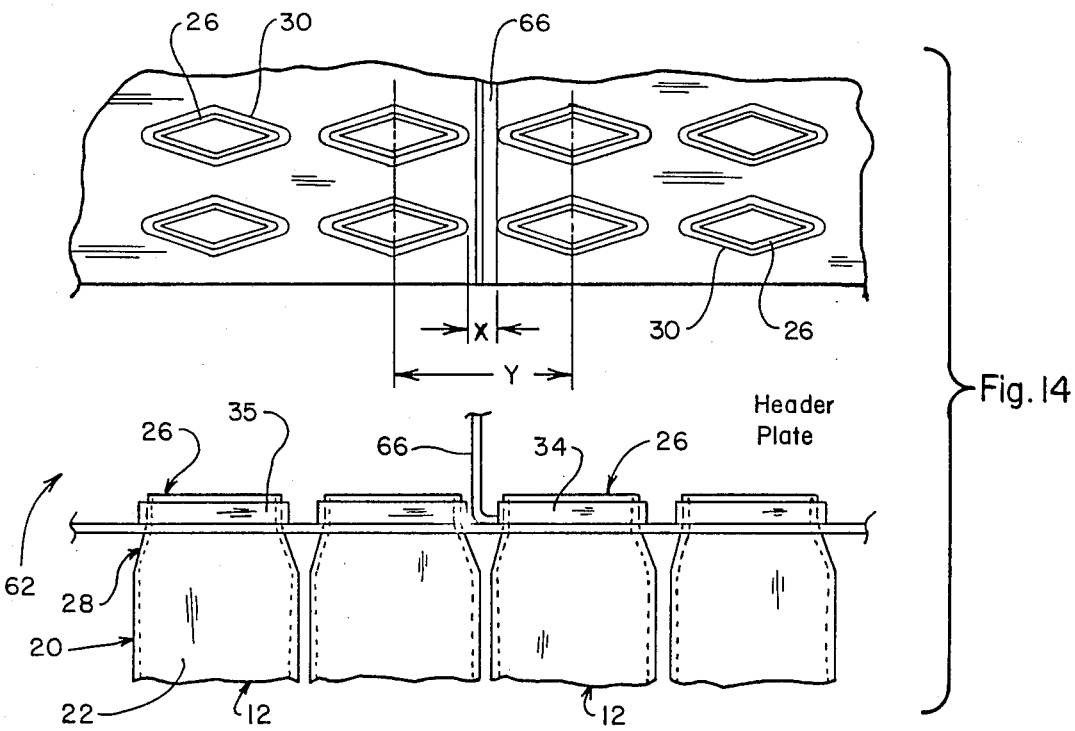
FIG. 14 is a fragmentary composite top and side view of a heat exchanger core construction utilizing the tube-to-header joints of the present invention in a multi-pass flow arrangement.
Figure 15:
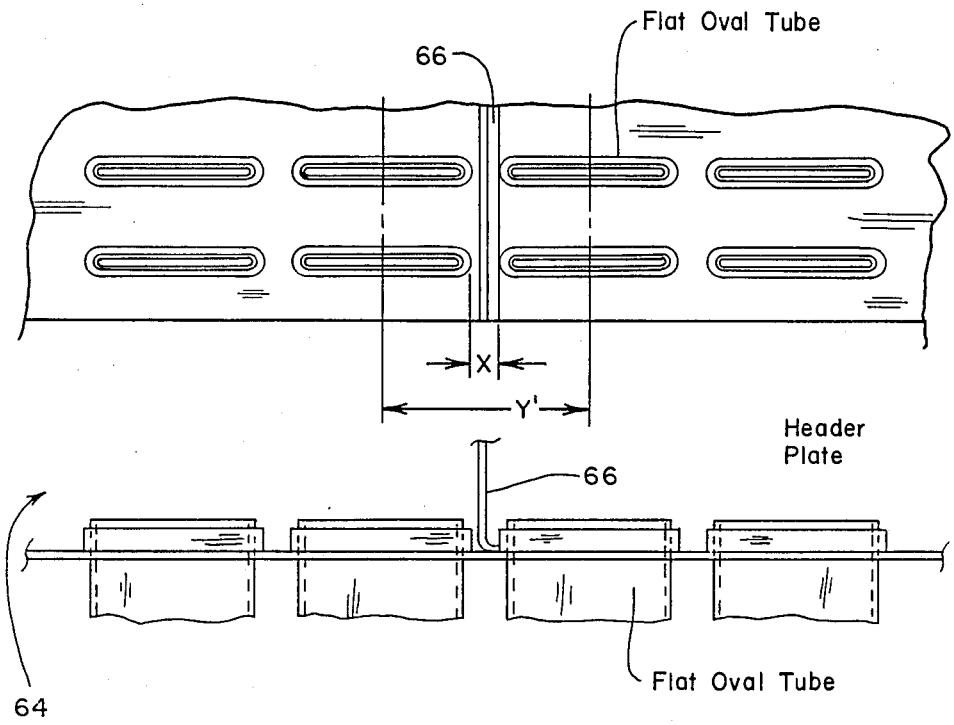
FIG. 15 is a fragmentary composite top and side view of a heat exchanger core construction utilizing conventional tube-to-header joints in a multi-pass flow arrangement.

Heat exchangers which require multiple tube side passes such as those shown in FIGS. 14 and 15 also benefit from the increased area between the tube rows afforded by the diamond-shaped tube-to-header joints. This increased area may be utilized to reduce row to row spacing in order to provide a more compact tube and fin layout. In many cases, in order to position inter pass baffles between adjacent tube rows, modification of the tube layout would be required in heat exchangers which incorporate conventional flat oval-shaped tube-to-header joints. If the row to row spacing is increased this also increases the fin width requirements. As illustrated in FIGS. 14 and 15, a minimum width "X" is required in order to position inter pass baffles 66 between adjacent tube rows. Dimension "Y" represents the minimum row to row spacing for the multi-pass assembly 62 which utilizes diamond-shaped tube-to-header joints as shown in FIG. 14 while dimension "Y'" indicates the row to row spacing for a conventional multi-pass assembly 64 which utilizes a conventional tube-to-header joint design as shown in FIG. 15. Increased row spacing (fin width) adds material hence weight and cost to the assembly and may offer only marginal performance enhancement.

Although the present invention has been shown and described with respect to heat exchanger core assemblies having a plurality of fin elements and a plurality of flat oval-shaped tube members, it is recognized that the teachings of the present invention are adaptable for use in other heat exchanger core assemblies including those assemblies having a plurality of round, elliptical, triangular, rectangular, hexagonal or any other shaped tube members which are adaptable to having the end portions thereof formed into a diamond shape. It should also be noted that all of the structural members comprising the core structures described herein, namely, the tube members, the fin elements and the header plates are formed of a suitable heat conducting metal such as aluminum, copper and/or copper clad, and are conventionally joined together by any suitable bonding means such as by soldering, crimping, and/or brazing. The specific type of bonding utilized may vary depending upon the particular application of the heat exchanger unit.

Thus there has been shown and described a novel diamond-shaped tube-to-header joint configuration which fulfills all of the objects and advantages sought therefor. Many changes, variations, modifications, and other uses and applications of the present tube-to-header joint construction will, however, become apparent to those skilled in the art after considering this specification and the accompanying drawings, and all such changes, variations, modifications, and other uses and applications which do not depart from the spirit and scope of the present invention are deemed to be covered by the invention which is limited only by the claims which follow.

What is claimed is:

1. A heat exchanger core construction consisting essentially of a plurality of header plates, a plurality of tube members adapted to receive a fluid medium therethrough extending in generally spaced parallel relationship between respective pairs of said header plates, and a plurality of fin elements disposed between respective pairs of said header plates in heat exchange relationship with said plurality of tube members, each of said tube members including a flat oval middle body portion and a diamond-shaped end portion located at each opposite end thereof, each of said tube members including transition portions extending from below each opposite end of said tube body portion to said respective diamond-shaped tube end portions, said diamond-shaped tube end portions having a reduced cross-sectional height and an increased cross-sectional width relative to the cross-sectional height and width of said flat oval middle body portion of said tube members and having an outside perimeter substantially the same as the outside perimeter of said flat oval middle body portion of said tube members, each of said header plates including a plurality of diamond-shaped tube slots extending therethrough, said plurality of diamond-shaped tube slots being positioned and arranged such that the diamond-shaped end portions of each of said tube members are receivable in respective ones of said diamond-shaped tube slots.

2. The heat exchanger core construction defined in claim 1 wherein the width of the middle portion of each diamond-shaped tube end portion is approximately 3.5 times larger than the width of the middle portion of said oval-shaped tube body portion.

3. The heat exchanger core construction defined in claim 1 wherein each of said diamond-shaped tube slots includes a circumferential flange extending at least partially therearound.

* * * * *